US006834513B2

(12) United States Patent
O'Brien et al.

(10) Patent No.: US 6,834,513 B2
(45) Date of Patent: Dec. 28, 2004

(54) CRANKCASE HEATER CONTROL

(75) Inventors: Michael J. O'Brien, Fort Wayne, IN (US); George C. Yang, Fort Wayne, IN (US); Michael Collins, Syracuse, NY (US)

(73) Assignee: Carrier Corporation, Farmington, CT (US)

( * ) Notice: Subject to any disclaimer, the term of this patent is extended or adjusted under 35 U.S.C. 154(b) by 542 days.

(21) Appl. No.: 09/849,705

(22) Filed: May 7, 2001

(65) Prior Publication Data

US 2002/0170780 A1 Nov. 21, 2002

(51) Int. Cl.[7] ..... F25B 43/02
(52) U.S. Cl. ..... 62/193; 62/126; 62/472
(58) Field of Search ..... 62/125, 126, 127, 62/129, 192, 193, 472

(56) References Cited

U.S. PATENT DOCUMENTS 4,236,379 A * 12/1980 Mueller ..... 62/126
4,307,775 A * 12/1981 Saunders et al. ..... 62/127 X
5,012,652 A 5/1991 Dudley
5,054,293 A * 10/1991 Schwecke ..... 62/126 X
5,062,277 A * 11/1991 Heitmann et al. ..... 62/129 X
5,920,191 A 7/1999 Maniero et al.

* cited by examiner

*Primary Examiner*—Harry B. Tanner

(57) ABSTRACT

A controller for controlling a heater associated with the crankcase of a compressor senses electrical current flowing through the heater. The sensing is preferably accomplished by a transformer in combination with an amplifier providing a feedback signal to the controller. The transformer is installed in the line which carries the electrical current flowing through the heater. The controller checks for the presence of an appropriate voltage level from the amplifier. In the event that the voltage level is not above a threshold level, the controller sends an alarm signal indicating that the heater is not operating properly.

8 Claims, 2 Drawing Sheets

CRANKCASE HEATER CONTROL

FIELD OF THE INVENTION

This invention relates to the control of a heater associated with the crankcase of a compressor. In particular, this invention relates to monitoring the status of such a crankcase heater.

BACKGROUND AND SUMMARY OF THE INVENTION

Compressors are utilized in many modem heating, cooling, and refrigeration applications. These compressors require oil to lubricate the moving parts of the compressor. The oil is often housed in a crankcase where it can be drawn up into the moving parts of the compressor. Heaters have been previously provided to heat the crankcase oil so as to boil off liquid refrigerant in the oil and maintain an appropriate viscosity of the oil for lubricating the moving parts of the compressor. The crankcase heater may run continuously or it may be activated in response to sensed conditions either in the crankcase or in other areas of either the compressor or the system in which the compressor operates. An example of the latter type of control is disclosed in commonly assigned U.S. Pat. No. 5,012,652 entitled "Crankcase Heater Control for Hermetic Refrigerant Compressors" issued to Kevin Dudley. The above described crankcase heater control as well as other heater controls all require one or more invasive sensors to sense conditions that are to be fed back to the control. These controls also do not necessarily provide a quick check as to whether a crankcase heater is operating properly shortly after it has been turned on since there is a lag between activation and changes to the sensed conditions fed back to the control.

It would be preferable to obtain information as to the operation of a crankcase heater without resorting to the use of invasive sensors. It would also be preferable to be able to quickly determine whether a crankcase heater is operating properly even if other systems may be deployed that use invasive sensors.

Briefly, the present invention senses the current flowing through a resistance heater. The resistance heater may be either located in the crankcase or external to the crankcase. The sensing is preferably accomplished by a transformer in combination with an amplifier providing a feedback signal to the programmed microprocessor. The transformer is installed in the line which carries the electrical current flowing through the resistance heater. The microprocessor checks for the presence of an appropriate voltage level from the amplifier. In the event that the voltage level is not above a threshold level, the microprocessor sends an alarm signal indicating that the crankcase heater is not operating properly.

BRIEF DESCRIPTION OF THE DRAWINGS

For a fuller understanding of the invention, reference should now be made to the following detailed description thereof taken in conjunction with the accompanying drawings, wherein.

DESCRIPTION OF THE PREFERRED EMBODIMENT

Figure 1:
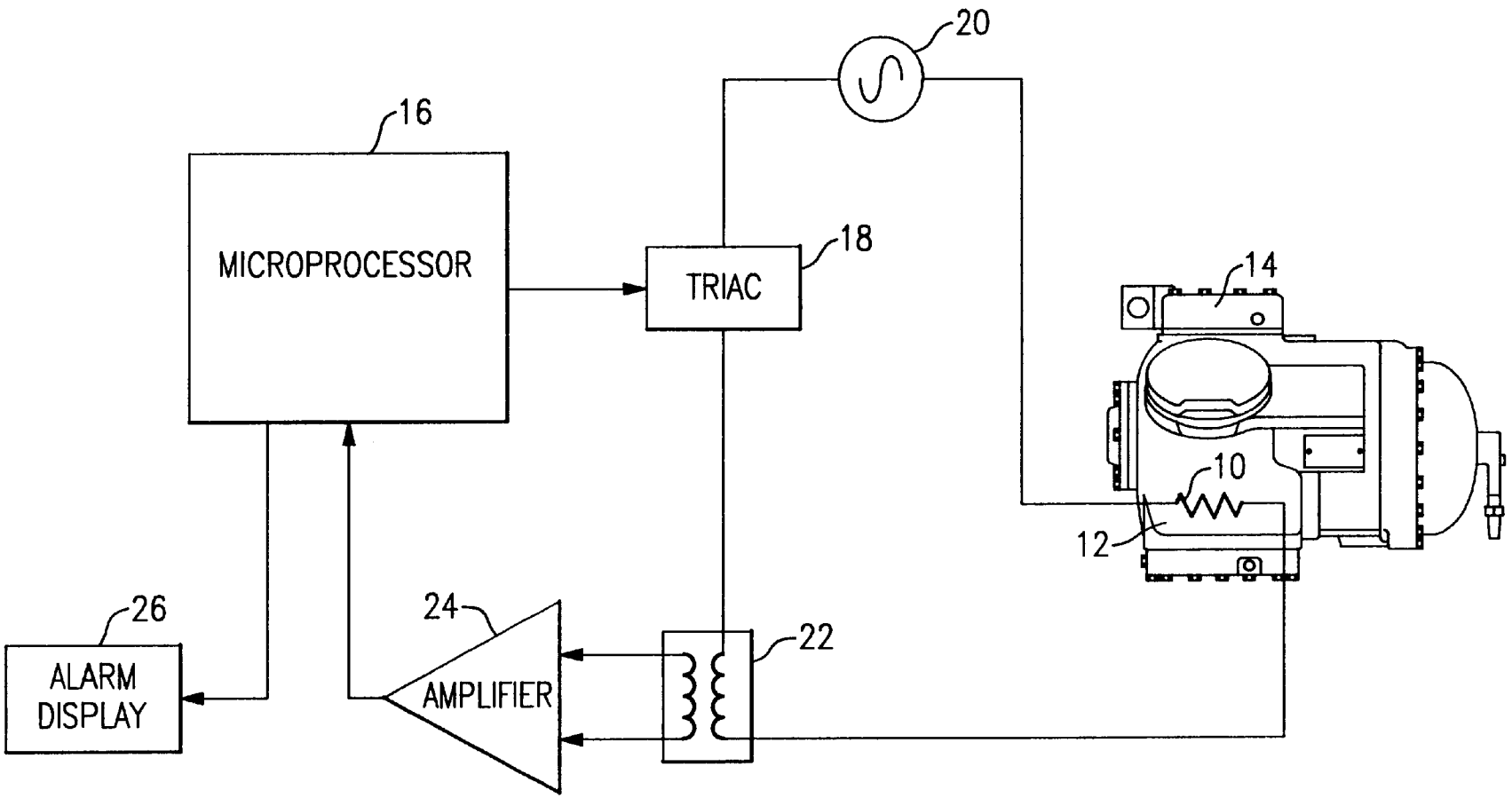
FIG. 1 illustrates a system for monitoring the operation of a heater, which heats crankcase oil for a compressor.

Referring to FIG. 1, a crankcase heater in the form of a resistance heater 10 is disposed within the crankcase 12 of a compressor 14. It is to be appreciated that the resistance heater could be external to the crankcase 12 and still heat the oil. In this regard, the heater could for instance be wrapped or mounted to the outer shell of the crankcase. It is also to be appreciated that the crankcase heater could be an inductance heater or any other type of heater that draws electrical current.

A microprocessor 16 switches a triac 18 on so as to cause current from an AC power source 20 to flow through the resistance heater 10. It is to be appreciated that switching devices other than a triac could be used to cause the current to flow from the AC power source 20. For example a relay contact switch could be used. Current flowing through the resistance heater 10 also flows through the primary winding of a transformer 22 located downstream of the resistance heater 10. An amplifier 24 associated with the secondary winding of the transformer 22 provides a voltage level signal to the microprocessor 16 indicative of the amount of current flow through the primary winding. As will be explained in detail hereinafter, the processor 16 examines the voltage produced by the amplifier 24 in order to determine whether the resistance heater 10 is operating properly. In the event that the heater is not operating properly, the processor sends an alarm signal to an alarm display 26. The alarm display 26 may be a light emitting diode on a control panel, a computer screen having the ability to display an alarm message, or any other suitable communication device capable of transmitting an appropriate message.

Figure 2:
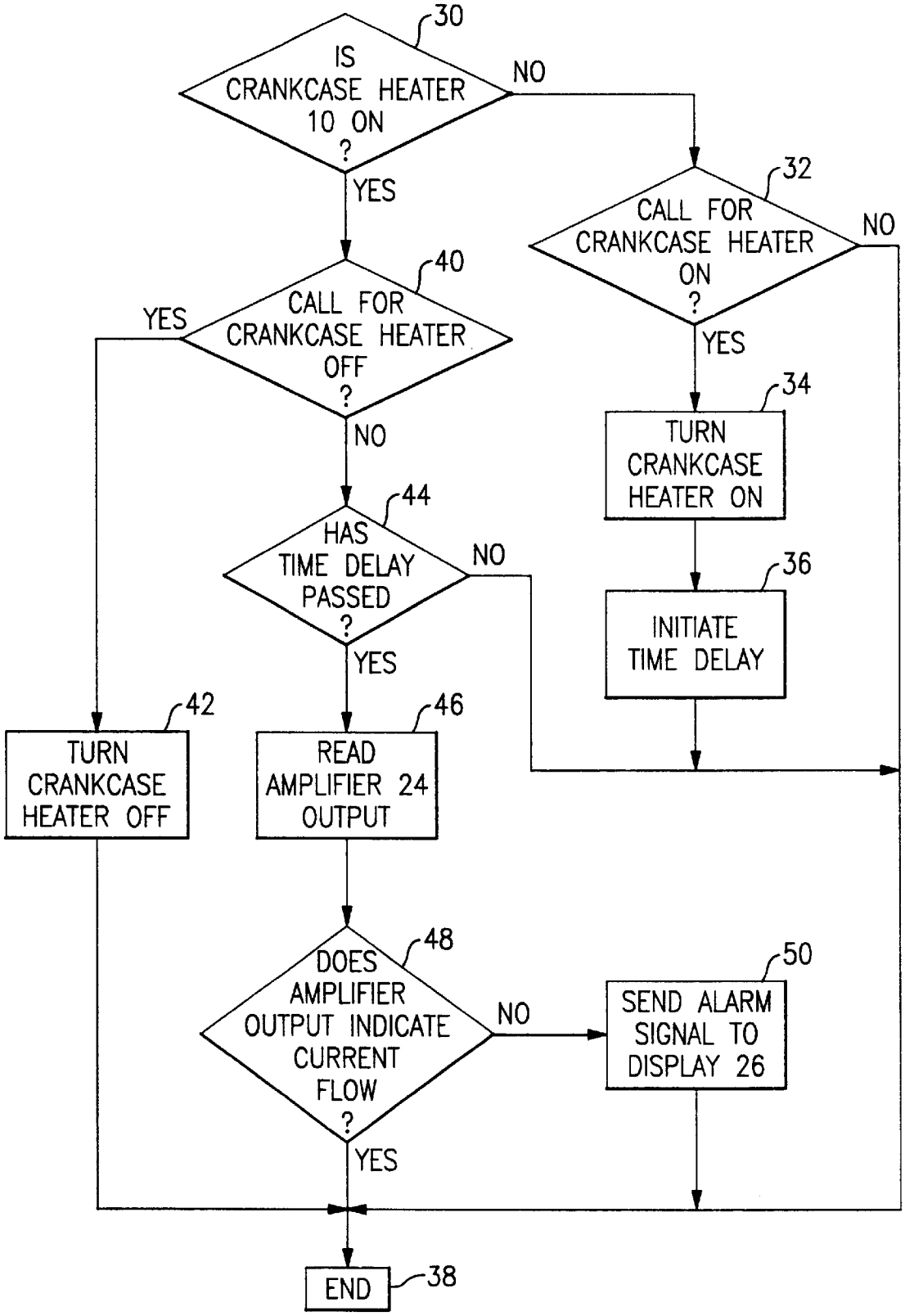
FIG. 2 illustrates the process implemented by a processor within the system of FIG. 1.

Referring now to FIG. 2, a flow chart of the process executed by the microprocessor 16 in controlling the resistance heater 10 or any other type of heater that draws electrical current is shown. The process begins with a step 30 wherein the microprocessor inquires as to whether the crankcase heater is on. This is preferably a check as to whether a signal has been sent to the output triac 18 so as to authorize power to the resistance heater 10. In the event that a command to the output triac is not present, then the microprocessor will proceed along the no path to a step 32 and inquire as to whether a call has been initiated to turn the crankcase heater on. It is to be appreciated that such a call could occur as a result of any number of different processes being implemented by either the microprocessor 16 or some other control device. These processes could include a process which initiates a call in response to one or more sensors providing information indicating that the resistance heater should be turned on. These processes could also be an authorization to turn the resistance heater on before turning the compressor 14 on. It is to be appreciated that the routine of FIG. 2 could be implemented with respect to any of these external processes.

The processor proceeds from step 32 to step 34 in the event that a call has been noted to turn the crankcase heater on. Referring to step 34, the microprocessor turns the crankcase heater on by issuing a signal to the triac 18. The processor proceeds in step 36 to initiate a time delay, which is preferably a clocked time count of a predetermined amount of time that would allow for the AC power to be applied to the crankcase heater 10 and for any transient current conditions to have passed. The processor proceeds from step 36 to a step 38, which terminates the routine of FIG. 2. It is to be appreciated that the processor will execute various other control procedures before again returning to the routine of FIG. 2. At such time, the processor will again inquire in step 30 as to whether the crankcase heater is on. Assuming that the microprocessor 16 has issued a signal to the triac 18 so as to turn the crankcase heater on, the processor will proceed to a step 40 and inquire as to whether there is a call for turning off the crankcase heater. It is to be appreciated that such a call could originate from other processes being implemented by the microprocessor such as has been previously described. When such a call is noted, the processor will proceed to a step 42 and turn the crankcase heater off before continuing to step 38 and terminating the routine of FIG. 2.

Referring again to step 40, in the event that there is not a call to turn the crankcase heater off, the microprocessor will proceed along the no path to a step 44 and inquire as to whether the time delay of step 36 has passed. In the event that this time delay has not passed, the processor will proceed out of step 44 to step 38 and terminate the routine of FIG. 2. On the other hand, if the time delay has passed, the processor will proceed from step 44 along the yes path to a step 46 and read the output of the amplifier 24. The processor will proceed to a step 48 and inquire as to whether the read amplifier output indicates the presence of current flow through the primary winding 22 of the current transformer. This is preferably a comparison of the read amplifier output to a threshold number stored in the microprocessor 16 indicative of the amount of voltage that should be present during a normal current flow situation in the primary winding of the transformer 22. In the event that the read amplifier output does not favorably compare with the stored threshold value, then the processor will proceed along the no path from step 48 to a step 50 and issue an alarm signal to the display 26. It is to be appreciated that the signal transmitted in step 50 can be either the authorization to a light emitting diode on a display panel or an authorization to display a message on a computer screen or an authorization to provide an appropriate message on some other communication device. In any event, the processor will proceed from step 50 to step 38 and terminate the routine of FIG. 2.

Referring again to step 48, in the event that the amplifier output does indicate the appropriate amount of current flow, then the processor will proceed along the yes path to step 38 and again terminate the routine of FIG. 2.

It is to be appreciated that the microprocessor will execute other processes for which it has been programmed before returning to the routine of FIG. 2. These processes preferably include the microprocessor determining whether the resistance heater is to be turned on or off. The execution of these processes should occur in a short period of time preferably less than five milliseconds before returning to step 30 of the routine in FIG. 2. It is to be appreciated that this period of time is substantially less than the time delay implemented in step 36 so as to cause several executions of the logic after initiating the time delay of step 36.

Although a preferred embodiment of the present invention has been described and illustrated, it will be apparent to those skilled in the art that changes or modifications may be made without departing from the scope of the present invention. It is therefore intended that the scope of the invention be limited only by the following claims.

What is claimed is:

1. A system for monitoring the operation of a heater for heating oil used in lubricating the moving parts of a compressor, said system comprising:

a circuit that allows electrical current to flow through the heating element of the heater for heating the oil;

a current sensing device for producing a voltage representative of the current flow in said circuit; and a processor operative to determine whether the voltage produced by said current sensing device is indicative of sufficient current flow in element of the heater for heating the oil.

2. The system of claim 1 wherein said current sensing device for producing a voltage representative of the current flow in the circuit comprises:

a transformer having a primary winding in the circuit allowing current flow through the heating element; and an amplifier connected to a secondary winding of the transformer for producing a voltage representative of the current flow through the secondary winding of the transformer.

3. The system of claim 1 wherein said circuit includes a switching device responsive to a signal from said processor so as to cause current to flow through the heating element and wherein said processor is operative to send the signal in response to a demand to turn the heater on.

4. The system of claim 3 wherein said processor is operative to initiate a time delay after sending the signal to the switching device and to thereafter read the voltage produced by said current sensing device after the initiated time delay has timed out.

5. The system of claim 4 wherein said processor is operative to produce an alarm signal when the read voltage does not indicate sufficient current flow in said circuit.

6. The system of claim 5 wherein said current sensing device for producing a voltage representative of the current flow in the circuit comprises:

a transformer having a primary winding in the circuit allowing current flow through the heating element; and an amplifier connected to a secondary winding of the transformer for producing a voltage representative of the current flow through the secondary winding of the transformer.

7. The system of claim 1 wherein said processor is operative to produce an alarm signal when the read voltage does not indicate current flow in said circuit.

8. The system of claim 1 wherein the circuit that allows electrical current to flow through the heating element includes a power supply upstream of said heating element and wherein said current sensing element is located downstream of said heating element whereby said current sensing device is only capable of producing a voltage representative of the current flow through the device when there is current flow through the heating element.

* * * * *